United States Patent [19]

Swenson

[11] Patent Number: 4,653,442

[45] Date of Patent: Mar. 31, 1987

[54] ENGINE STARTING CYCLE AND OVERCRANK CONTROL SYSTEM

[75] Inventor: Steven L. Swenson, Circle Pines, Minn.

[73] Assignee: Onan Corporation, Minneapolis, Minn.

[21] Appl. No.: 787,769

[22] Filed: Oct. 15, 1985

[51] Int. Cl.[4] ..... F02N 11/08

[52] U.S. Cl. ..... 123/179 B; 123/179 R; 290/37 A; 290/38 C

[58] Field of Search ..... 123/179 B, 179 BG, 179 R; 290/38 C, 37 A, 38 R, 38 E

[56] References Cited

U.S. PATENT DOCUMENTS

| | | | |
|---|---|---|---|
| 3,248,555 | 4/1966 | Fried | 123/179 B |
| 3,415,999 | 12/1968 | Noury | 123/179 B |
| 4,231,073 | 10/1980 | Suchko | 123/179 B |
| 4,236,594 | 12/1980 | Ramsperger | 290/38 E |
| 4,392,059 | 7/1983 | Nespor | 123/179 BG |

*Primary Examiner*—Andrew M. Dolinar

*Attorney, Agent, or Firm*—Wigman & Cohen

[57] ABSTRACT

An engine starting cycle cranking and rest period timing circuit and an overcrank shut down circuit includes a 24 stage frequency divider connected to starting motor relays, and an engine starter disconnect circuit and a start signal circuit functioning to provide a predetermined number of engine starter motor cranking periods followed by rest periods. The frequency divider circuit is connected to provide coordination of the starter motor cranking cycle with an overcrank signal generated by the frequency divider. An overcrank signal will activate only when all three output terminals of the frequency divider circuit are simultaneously of the same signal amplitude which will always occur at the predetermined maximum number of crank periods.

2 Claims, 2 Drawing Figures

ENGINE STARTING CYCLE AND OVERCRANK CONTROL SYSTEM

BACKGROUND OF THE INVENTION

Field of the Invention

The present invention pertains to a control circuit for controlling an engine starter motor crank cycle to control the timing of the crank and rest cycle and to automatically shut down the starting circuit after a predetermined number of crank cycles.

BACKGROUND

In various internal combustion engine applications, including electrical generator set units, the engine electric starting motor is controlled to automatically crank the engine for a predetermined time period followed by a rest period of the starter motor and for a predetermined number of cranking cycles. Prior art control circuits for accomplishing the crank cycle timing and the number of crank cycles before a fault shut down signal is produced have been relatively complicated and are difficult to coordinate to provide a predetermined crank cycle period and a properly timed overcrank shut down signal. In this regard, it is important that the overcrank shut down signal not be initiated just after a crank cycle has commenced so as to minimize the chance of damage to the starter motor and other components of the engine system. It is to this end that the present invention has been developed with a view to providing an improved and reliable engine starting cycle and overcrank timing control system.

SUMMARY OF THE INVENTION

The present invention provides an improved starting control circuit for an internal combustion engine including automatically controlled engine units such as electrical generator sets.

In accordance with one aspect of the present invention, there is provided a control circuit which automatically times the cranking cycle of the engine starting motor and automatically provides a fault shut down signal after a predetermined number of crank cycles. The control circuit advantageously prevents the initiation of a crank cycle after the predetermined number of cycles so that the overcrank shut down signal does not occur in the middle or at the initiation of a starting motor cranking.

In accordance with still a further aspect of the present invention, there is provided a control circuit for controlling the start cranking cycle for an internal combustion engine having an electrical starting motor wherein the control circuit includes a single prefabricated circuit which operates to control the crank cycle frequency and the overcrank shut down signal to reliably provide an overcrank shut down signal at the end of a predetermined number of cranking cycles, and in particular, at the completion of four motor cranking cycles.

Those skilled in the art will recognize the abovementioned features and advantages of the present invention as well as additional superior aspects thereof upon reading the detailed description which follows in conjunction with the drawing.

DESCRIPTION OF THE PREFERRED EMBODIMENT

Figure 1:
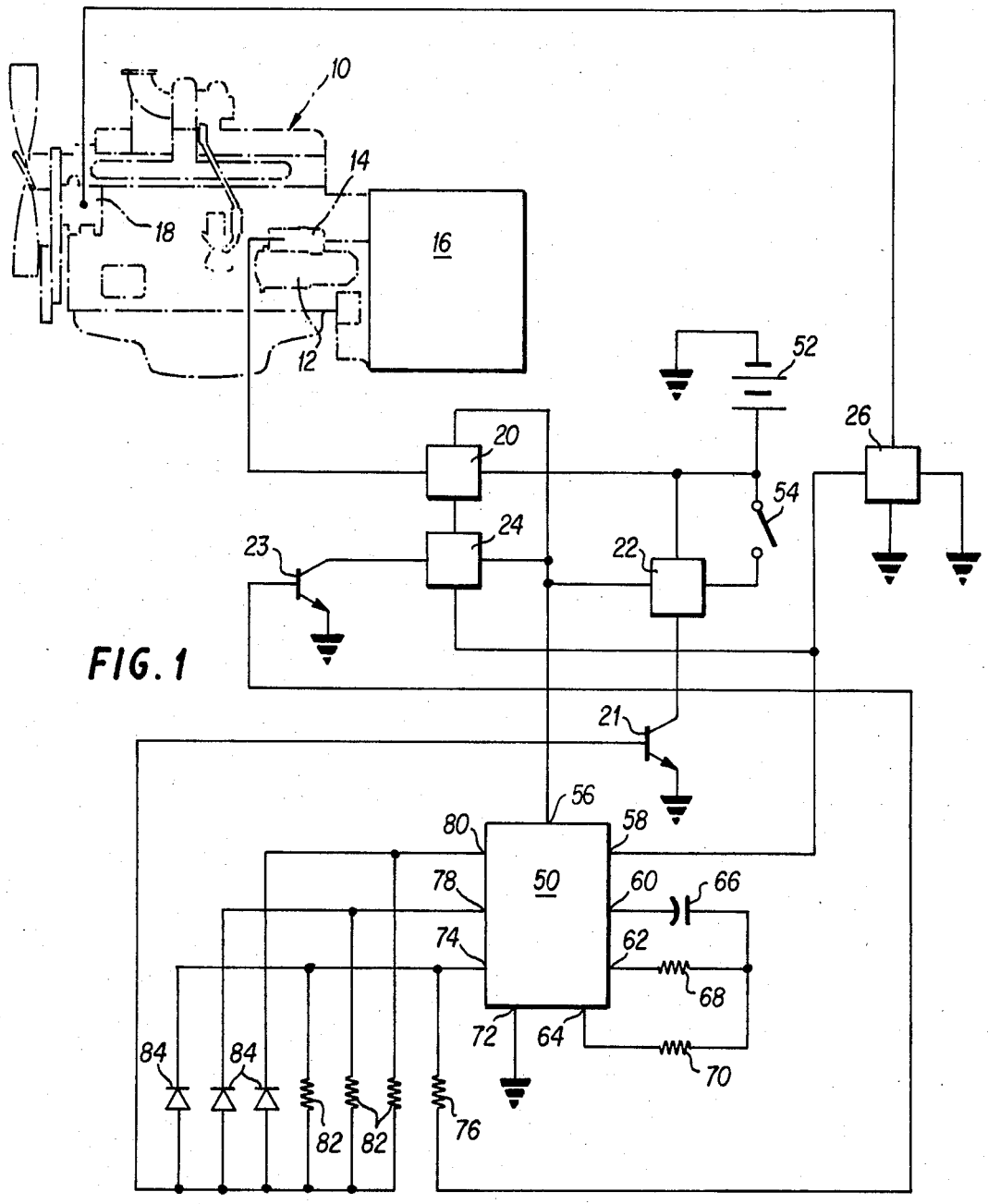
FIG. 1 is a schematic diagram of an engine starting control circuit in accordance with the present invention.

In the description which follows, like parts are marked throughout the specification and drawing with the same reference numerals, respectively. In the drawing, certain portions of the invention are shown in somewhat generalized schematic form in the interest of clarity and conciseness.

Referring to FIG. 1 there is illustrated a schematic diagram of an engine generator set and control circuit therefor. The generator set illustrated includes an internal combustion engine 10 including an electric starting motor 12 and a suitable starting motor relay or solenoid 14. The engine 10 is adapted to drive an electrical generator 16 and is configured for use in various applications such as standby power generation wherein automatic control of starting of the generator set is accomplished in response to a suitable signal. The engine 10 includes a second electrical generator or alternator 18 for providing a variable voltage output signal proportional to engine speed. The engine driven generator set characterized by the aforedescribed components may be controlled to commence a starting cycle in response to the operation of a manually actuated switch, a remotely controlled switch, or a switch including control means which senses or receives one of various types of signals. The control circuit includes a source of electrical energy such as a 12 volt d.c. source 52 which is operable to be in circuit with the starter motor relay 14 through first relay means 20. The alternator 18 is also adapted to provide an output signal to a starting cycle disconnect relay, generally designated by the numeral 26.

Typically, remotely controlled engine power applications such as electrical generator sets are automatically controlled to start and provide output power under various circumstances. The automatic control of the starting cycle should povide for repeated engine cranking and rest periods for a predetermined number of cranking cycles to assure engine start. For example, an engine cranking cycle should not be indefinite if the engine fails to start during the crank period in order to prevent starter motor overheating and to also allow other conditions affecting engine start up to stabilize. In this regard, it is desirable to provide for a plurality of cranking periods followed by subsequent rest periods of the engine starting motor until a predetermined number of cranking cycles is accomplished. It is also desirable to provide a crank cycle or overcrank shut down signal to the control system in the event that the engine does not start after the predetermined number of cranking cycles has been accomplished. It is particularly desirable that the overcrank shut down signal be provided at the onset of a cranking cycle to prevent actual energization of the starter motor after the predetermined number of crank cycles has been accomplished.

Prior art type control circuits have been difficult to design and do not provide reliable performance in accordance with the desired parameters. For example, U.S. Pat. No. 3,866,059 issued Feb. 11, 1975 to Przywozny teaches a complex fault circuit system for terminating flow of fuel to an engine if the engine has not been started after a predetermined number of successive crankings or for terminating closure of an ignition switch when the engine starts.

Figure 2:
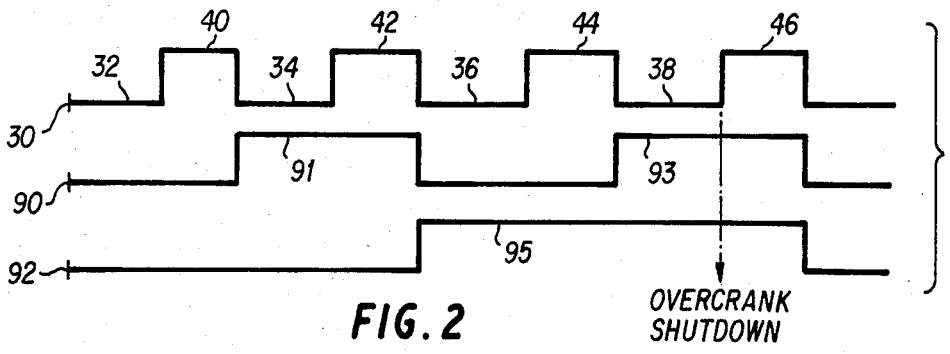
FIG. 2 is a timing diagram indicating the condition of the output signals of certain portions of the circuit illustrated in FIG. 1.

Referring to FIG. 2, there is illustrated a timing diagram wherein the abscissa is time and the ordinate is relative signal strength. For example, the line 30 indicates the diagram of a first signal which will effect energization of the starter motor 12 during the periods 32, 34, 36 and 38 and wherein the starter motor 12 is de-energized during the periods 40, 42, 44 and 46.

In accordance with some engine application specificatons, it is desirable that the number of crank periods be limited to a total of four, and it is also desirable that the onset of the fifth crank period be prevented so that an overcrank fault or shut down signal does not occur during or only shortly after starter motor engagement to minimize the chance of damage to the starter motor and the engine. In this regard, a particularly unique circuit has been developed utilizing a commercially available integrated circuit device illustrated in FIG. 1 and generally designated by the numeral 50. The circuit device 50 is preferably characterized as a 24 stage frequency divider of a type manufactured by Motorola, Inc. under their part number MC 14521 B. This device consists of a chain of 24 flip-flop circuits with an input circuit that allows a mode of oscillation as an RC oscillator. In the circuit illustrated in FIG. 1, the standardized connecting pin assignment numbers will be cross-referenced with the numbers designated according to the table provided herein below.

TABLE I

| Pin No. | Ref. Numeral |
|---|---|
| 1 | — |
| 2 | 58 |
| 3 | 72 |
| 4 | 64 |
| 5 | 56 |
| 6 | 60 |
| 7 | 60 |
| 8 | 72 |
| 9 | 62 |
| 10 | 74 |
| 11 | 78 |
| 12 | 80 |
| 13 | — |
| 14 | — |
| 15 | — |
| 16 | 56 |

The circuit device 50 is operable to receive an input signal from a low voltage source 52 by way of a suitable switch 54 which may be manually actuated or automatically controlled. An input signal to the device 50 is applied at terminal pin 56. The starter disconnect circuit 26 produces an output signal upon sensing a started condition of the engine 10 which is applied to the device 50 at terminal 58. Terminals 60, 62 and 64 are interconnected by way of a capacitor 66, a resistor 68 and a resistor 70. Terminal 72 is connected to ground and terminal 74 is connected to second relay means 24 through a resistor 76 and drive transistor 23. Terminals 74, 78 and 80 are connected to third relay means 22 by way of resistors 82 and drive transistor 21. The specifications of the capacitor 60, the resistors 68, 70, 76, 82 and the diodes 84 are given in the following table number II.

TABLE II

| | |
|---|---|
| capacitor 66 | .001 uf |
| resistor 68 | 100 k ohms |
| resistor 70 | 50 k ohms |
| resistor 76 | 10 k ohms |
| resistor 82 | 10 k ohms |
| diode 84 | 1 amp, 200 v. d.c. rev. breakdown |

The first relay means 20 is normally open and is responsive to receiving a signal from third relay means 22 when switch 54 is closed to initiate cranking of starter motor 12. The third relay means 22 is normally closed and is a latching relay responsive to receiving a summed signal output, called a second signal, at terminals 74, 78 and 80 simultaneously through resistors 82 to open to interrupt the energization of the starting motor 12 at the end of the final crank cycle. The second relay means 24 is normally closed and is responsive to receiving said first signal from the terminal 74 to open to de-energize the starting motor 12 during the rest cycles 40, 42, 44, and 46 when third relay means 22 is closed. When second relay means 24 is opened, the ground path between first relay means 20 and the ground relay 26 is broken, thus preventing any crank from occurring. When second relay means 24 is closed during crank periods 32, 34, 36, and 38, a ground path for first relay means 20 exists so that the starter motor can be cranked.

The frequency of said first signal at terminal 74 characterized by the diagram line 30 is determined by the capacitance of the capacitor 66 and the resistance of the resistor 68. Accordingly, the length of time or the crank cycle or cranking effort as indicated by the line segments 32, 34, 36 and 38 may be varied by adjusting the resistor capacitor circuit including the capacitor 66 and the resistor 68.

Referring briefly again to FIG. 2, the diagram also illustrates the relative value of a third signal at terminal 78 indicated by the line 90 and the relative value of a fourth signal at terminal 80 indicated by the line 92. As indicated by the diagram in FIG. 2, the third signal output at terminal 78 is relatively high during periods 91 and 93 and the fourth signal output at terminal 80 is relatively high during the period 95. As indicated by the diagram of FIG. 2 at the onset of energization of the circuit device 50, a repeating relatively high first signal is output at terminal 74 at a predetermined frequency as indicated by the line 30 and concomitantly a third signal having half the frequency of the first signal indicated by the line 30 is indicated by the line 90. Still further, a fourth signal is generated at terminal 80 having half the frequency of the third signal generated at 78. When the signal strengths at terminals 74, 78 and 80 are all relatively high, as indicated by the periods 46, 93 and 95, then a high second signal is passed to drive transistor 21 through resistors 82 to open third relay means 22 and the shut down of the starter motor 12. This second signal is always provided at the end of the fourth cranking cycle as indicated by the cranking period 38 in FIG. 2. In this way, in one particular circuit device, signals may be generated to provide for a predetermined number of cranking cycles, and the cranking effort will be terminated reliably at the end of the last cranking cycle. Moreover, if the engine starts and a sufficient signal strength is conditioned by the relay 26, a signal is imposed on terminal 58 to effect a conditioning of the circuit 50 to cease timing, and relay 26 is opened to discontinue starter motor energization. Of course, if the switch 54 is opened, the circuit 50 is de-energized and first relay means 20 is opened to prevent starter motor energization.

Those skilled in the art will recognize from the foregoing description that the utilization of the circuit device 50 in a circuit as described herein provides a particularly unique and reliable signal source for operating the starter motor of an internal combustion engine through an automatic starting cycle having a predetermined number of cranking cycles and wherein the starting effort is reliably terminated always at the end of the last of the predetermined number of motor cranking efforts. Although a preferred embodiment of the invention has been described in detail, those skilled in the art will recognize that various modifications and substitutions may be made to the specific arrangement described to alter the number of crank cycles and/or independently adjust the time period of the crank and rest cycles without departing from the scope and spirit of the invention as recited in the appended claims.

What is claimed:

1. A control system for operating the starting motor of an internal combustion engine to provide a predetermined number of engine cranks, said control system including:

an energy source adapted to energize said starting motor;

first relay means operable to connect and disconnect said source with respect to said starting motor;

second relay means in circuit with said first relay means for energizing and de-energizing said first relay means to effect a cranking of the starter motor;

an electrical circuit device operably connected to both of said relay means for generating a first signal which effects cyclic energization of the second relay means, and a second signal which de-energizes said first relay means after a predetermined number of cranks to automatically shut down said starter motor to prevent overcranking;

third relay means in circuit between said circuit device and said first relay means for effecting de-energization of said first relay means when said circuit device produces and applies said second signal thereto; and switch means for connecting said circuit device with an electrical source to activate said circuit device to produce said second signal.

2. The control system set forth in claim 1 wherein:

said circuit device comprises a frequency divider circuit which produces said second signal which in turn comprises said first signal, a third signal having a frequency of one-half said first signal, and a fourth signal having a frequency of one-half said third signal.

* * * * *